United States Patent [19]

Tough

[11] Patent Number: 4,976,118

[45] Date of Patent: Dec. 11, 1990

[54] METHOD FOR PRODUCING BACKING MATERIAL FOR CARPET UNDERLAY

[75] Inventor: William H. Tough, Tayport, Scotland

[73] Assignee: Scott & Fyfe Limited, Fife, Scotland

[21] Appl. No.: 272,433

[22] Filed: Nov. 17, 1988

[30] Foreign Application Priority Data

Nov. 24, 1987 [GB] United Kingdom ..... 87.27449

[51] Int. Cl.[5] ..... D04B 23/10; D04B 15/20

[52] U.S. Cl. ..... 66/85 A; 66/114; 66/202; 112/438

[58] Field of Search ..... 66/85 A, 114, 192, 193, 66/202; 112/438

[56] References Cited

U.S. PATENT DOCUMENTS

| | | | |
|---|---|---|---|
| 2,936,603 | 5/1960 | Lewine | 66/193 |
| 3,226,958 | 1/1966 | Niemer et al. | 66/202 |
| 3,230,744 | 1/1966 | Carbonaro | 66/85 A |
| 3,782,137 | 1/1974 | Hughes | 66/192 |
| 4,727,731 | 3/1988 | Tough | 66/85 A |

FOREIGN PATENT DOCUMENTS

| | | | |
|---|---|---|---|
| 50-35594 | 11/1975 | Japan | 66/192 |

*Primary Examiner*—Wm. Carter Reynolds
*Attorney, Agent, or Firm*—Bacon & Thomas

[57] ABSTRACT

A composite sheet material which is particularly useful as a backing material for carpet underlay is a stitched crepe paper sheet 5 with rows of apparent projections 13 formed therein between parallel rows of stitches 10 by deforming the crepe paper sheet without puncturing the paper. The stitches 10 substantially restrict the extensibility of the crepe paper sheet 5 and the apparent projections 13 are formed at a position in the crepe paper sheet 5 directly in line with the ends 11 of the stitches 10. According to the preferred method, each apparent projection 13 is in reality a depression between two projections formed in the opposite surface of the crepe paper sheet without puncturing the paper. In an alternative embodiment there is a pair of apparent projections 13 formed in the crepe paper sheet 5 between adjacent rows of stitches 10.

6 Claims, 2 Drawing Sheets

METHOD FOR PRODUCING BACKING MATERIAL FOR CARPET UNDERLAY

BACKGROUND OF THE INVENTION

This invention relates to a backing material for a carpet underlay and more particularly to such a backing material which is a composite sheet material comprising rows of stitches formed in a base crepe paper sheet.

The present Applicants previously developed a stitched crepe paper as a backing material for a carpet underlay, as described and claimed in U.K. Patent No. 1,422,940. This stitched crepe paper product has a dimensional stability and is capable of adhesion to a sheet of foamed or sponge rubber, both of which qualities are particularly desirable in a backing for a carpet underlay.

When used as a backing material for carpet underlay this stitched crepe paper product bas been supplied by Applicants with a series of rows of perforations between the rows of side-by-side stitches. The rows of perforations were introduced into the stitched crepe paper product following complaints that squeaking tended to occur when pressure was applied to the carpet underlay by persons walking thereon. Following the introduction of the rows of perforations, the tendency to squeaking was eliminated, and the stitched crepe paper has therefore always been provided with a least one row of perforations between adjacent rows of stitches.

The rows of perforations in the stitched crepe paper have been made by unthreaded needles mounted on the needle bar of the sewing-knitting machine on which the stitched crepe paper product is manufactured. In practice this is readily done by simply providing no thread for, for example, alternate needles on the needle board, although alternative commercial products have been produced by providing thread for, in one case, only one needle in three and, in another case, only one needle in four of the needles on the needle bar of the sewing-knitting machine.

It was surprisingly found that the stitched crepe paper with the rows of perforations alternating with the rows of stitches has a higher tensile strength in the longitudinal direction, that is to say in the direction of the rows of stitches, than a stitched crepe paper which has no perforations in addition to those made in the course of stitching the crepe paper.

However, the presence of perforations in the stitched crepe paper has the disadvantage of impairing the appearance of the carpet underlay. This is a particular disadvantage when heavier weights of crepe paper are used, for example when paper of a base weight of 67 gms/m$^2$ creped to 88 gms/m$^2$ is used the perforations tend to be more variable in size and more noticeable than when a paper of base weight 39 gms/m$^2$ creped to 72 gms/m$^2$ is used. The larger holes which tend to be made by the unthreaded needles piercing the heavier papers make the presence of the coloured rubber of the carpet underlay more noticeable and the whole product less attractive visually. The appearance of the carpet underlay is commercially important, even though the carpet underlay is not visible when in use under a carpet.

Accordingly the problem has arisen of providing a backing material for a carpet underlay which is of pleasing appearance and which is not subject to any significant reduction in longitudinal tensile strength relative to the perforated backing materials currently used, and which also is not subject to undesirable squeaking when pressure is applied in use.

Surprisingly it has been found that this problem can be solved by providing deformations or embossed projections in rows lying between the side-by-side rows of stitches in a stitched crepe paper sheet material.

SUMMARY OF THE INVENTION

In accordance with the present invention therefore there is provided a backing material for a carpet underlay which comprises a sheet of crepe paper having parallel rows of stitches therein, the stitches substantially restricting the extensibility of the crepe paper sheet, and the crepe paper sheet between the rows of stitches being deformed without puncturing the paper so that rows of projections embossed in the crepe paper sheet lie between the rows of stitches.

Conveniently the projections are embossed in the crepe paper sheet between perforations in the crepe paper sheet through which stitching thread passes.

In accordance with one preferred embodiment of the present invention there are two rows of projections embossed in the crepe paper sheet between adjacent rows of stitches.

In accordance with another preferred embodiment of the present invention there is one row of projections embossed in the crepe paper sheet between adjacent rows of stitches.

Advantageously the embossed projections are formed in the opposite surface of the crepe paper sheet to the surface on which the stitching loops lie.

A backing material according to the present invention preferably further includes weft threads laid on one surface of the crepe paper sheet and secured to the crepe paper sheet by the rows of stitches.

In accordance with one preferred embodiment of the present invention which will be described there is provided a backing material for a carpet underlay which comprises a longitudinally extensible sheet of crepe paper having crimps therein, a series of side-by-side rows of stitches formed in .the crepe paper sheet transversely to the crimps of the crepe paper so that the stitches substantially restrict the longitudinal extensibility of the crepe paper sheet, weft threads laid substantially parallel to the crimps in the crepe paper sheet and secured to the surface of the crepe paper sheet opposite to the surface on which the loops of the stitches lie, and a series of pairs of projections embossed, without puncturing the crepe paper sheet, in the surface of the crepe paper sheet on which the weft threads are laid, each pair of projections being embossed in the crepe paper sheet immediately between corresponding stitching holes in adjacent rows of stitches such that the surface of the crepe paper sheet bearing the loops of the stitches has raised portions symmetrically disposed between adjacent rows of stitches, said raised portions alternating longitudinally of the sheet with a plurality of crimps in the crepe paper sheet.

In accordance with another preferred embodiment of the present invention which will be described there is provided a backing material for a carpet underlay which comprises a longitudinally extensible sheet of crepe paper having crimps therien, a seris of side-by-side rows of stitches formed in the crepe paper sheet transversely to the crimps having crimps therein, of the crepe paper so that the stitches substantially restrict the longitudinal extensibility of the crepe paper sheet, weft threads laid substantially parallel to the crimps in the crepe paper sheet and secured to the surface of the crepe paper sheet opposite to the surface on which the loops of the stitches lie, and a series of rows of projections embossed, without puncturing the crepe paper sheet, in the surface of the crepe paper sheet on which the weft threads are laid, each projection of each row being embossed in the crepe paper sheet immediately between corresponding stitching holes in adjacent rows of stitches such that the surface of the crepe paper sheet bearing the loops of the stitches has a pair of raised portions symmetrically disposed between adjacent rows of stitches, each pair of raised portions alternating longitudinally of the sheet with a plurality of crimps in the crepe paper sheet.

According t the present invention there is further provided a method of producing a backing material for a carpet underlay by forming a series of side-by-side rows of stitches in a crepe paper sheet, which method further includes the step of deforming the crepe paper sheet without puncturing the crepe paper sheet to form at least one row of projections in the crepe paper sheet between each pair of side-by-side rows of stitches.

A backing material for carpet underlay may be made in accordance with the present invention by forming side-by-side rows of stitches in a crepe paper sheet which has already had rows of projections embossed in it. In such a case there is difficulty in locating the rows of stitches symmetrically and consistently between the rows of embossed projections in order to achieve a pleasing appearance in the final product.

Surprisingly the present Applicants have found that it is possible to produce the improved backing material for carpet underlay in accordance with the present invention by utilizing a sewing-knitting machine to produce the embossed projections in the crepe paper sheet.

Advantageously therefore the step of deforming the crepe paper sheet is performed simultaneously with the perforation of the crepe paper sheet by needles forming corresponding stitches in the said side-by-side rows of stitches.

Preferably in accordance with this aspect of the present invention there is provided a method of producing a backing material for a carpet underlay which comprises the steps of feeding a crepe paper sheet as a base sheet in a sewing-knitting machine which has a needle bar comprising embossing stubs disposed between stitching needles, the crimps of the crepe paper sheet being at right angles to the direction of feeding the crepe paper sheet in the sewing-knitting machine, operating the sewing-knitting machine to form a series of side-by-side rows of stitches in the crepe paper sheet to reduce substantially the extensibility of the crepe paper sheet and, simultaneously with the formation of each stitch, to deform the crepe paper sheet without puncturing the crepe paper sheet to produce embossed projections in the surface of the crepe paper sheet, and causing the machine to lay weft threads on the crepe paper sheet so that the weft threads are parallel to the crimps in the crepe paper, the weft threads being secured to the crepe paper sheet by the rows of stitches.

In one method of performing the present invention which will be described two side-by-side projections are embossed between corresponding stitches in adjacent side-by-side rows of stitches.

More specifically in accordance with this aspect of the present invention there is provided a method of making a backing material for a carpet underlay in a sewing-knitting machine which comprises a reciprocable needle bar carrying a series of needles and a series of pairs of blunt stubs each pair of blunt stubs separating adjacent needles in the series of needles, a series of restraining members for restraining a sheet material to facilitate perforation thereof by the needles, the series of restraining members having the same pitch as the series of needles with the restraining members situated midway between adjacent needles, and means for reciprocating the needle bar to cause the needles to perforate the sheet material, the method comprising the steps of feeding a crepe paper sheet material to the sewing-knitting machine with the crimps of the crepe paper sheet at right angles to the direction of feeding the crepe paper sheet material and forming parallel side-by-side rows of stitches therein, the reciprocation of the needle bar in the formation of the stitches being such that each pair of blunt stubs presses the crepe paper sheet material on either side of the restraining surface on one of the restraining members thereby forming a pair of embossed projections in the crepe paper sheet material without puncturing the crepe paper sheet.

In another method of performing the invention which will be described a single projection is embossed between corresponding stitches in adjacent side-by-side rows of stitches.

More specifically in accordance with this aspect of the present invention there is provided a method of making a backing material for a carpet underlay in a sewing-knitting machine which comprises a reciprocable needle bar carrying a series of needles and a series of blunt stubs, each blunt stub separating adjacent needles in the series of needles so that needles and stubs alternate along the needle bar, a series of restraining members for restraining a sheet material to facilitate perforation thereof by the needles, the series of restraining members having half the pitch of the series of needles with the restraining members situated mid-way between a needle and a stub adjacent to that needle, and means for reciprocating the needle bar to cause the needles to perforate the sheet material, the method comprising the steps of feeding a crepe paper sheet material to the sewing-knitting machine with the crimps of the crepe paper sheet at right angles to the direction of feeding the crepe paper sheet material and forming parallel side-by-side rows of stitches therein, the reciprocation of the needle bar in the formation of the stitches being such that each blunt stub presses the crepe paper sheet material between the restraining surfaces on a pair of the restraining members thereby forming an embossed projection in the crepe paper sheet material without puncturing the crepe paper sheet.

BRIEF DESCRIPTION OF THE DRAWINGS

The present invention will be further understood from the following detailed description of preferred embodiments thereof which is made, by way of example, with reference to the accompanying diagrammatic drawings, in which.

DETAILED DESCRIPTION

Figure 1:
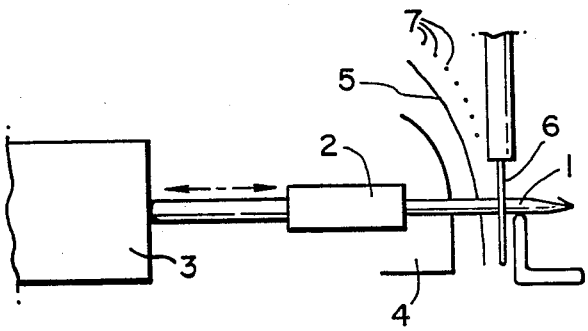
FIG. 1 is a side representation of a part of a sewing-knitting machine showing a needle immediately after it has perforated a crepe paper sheet.

In the drawings the same or similar parts are designated by like reference numerals.

FIG. 1 of the accompanying drawings is a diagrammatic representation showing one needle 1 mounted on a needle bar 2 in a position in which the needle bar has been advanced by a reciprocating means 3 to project the needle 1 through the gate 4 to pierce a sheet 5 of crepe paper which is being fed between the gate 4 and a series of restraining pins 6. Weft threads 7 are diagrammatically represented as being in the process of being laid on the crepe paper sheet 5. The crimps in the sheet 5 of crepe paper are at right angles to the direction in which the crepe paper sheet is fed and therefore parallel to the weft threads 7.

Figure 2:
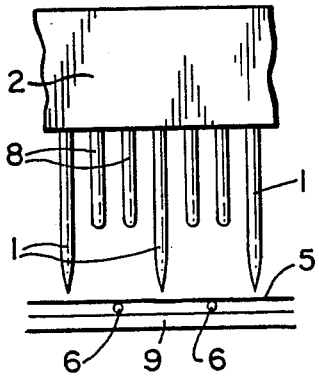
FIG. 2 is a plan view of a part of the needle bar of the sewing-knitting machine of FIG. 1 showing the needles before they perforate the crepe paper sheet.

As more clearly shown in FIG. 2 a needle bar 2 carries a series of needles 1 each needle 1 being separated from its neighbour in the series by two embossing stubs 8. The space between adjacent needles in this example is approximately one third of an inch (eight millimeters) and a series of vertical restraining pins 6 has a similar spacing or pitch with the restraining pins 6 arranged to be mid-way between adjacent needles 1 on the needle bar 2. The restraining pins 6 are positioned to extend immediately in front of a closing bar or sinker unit 9.

Figure 3:
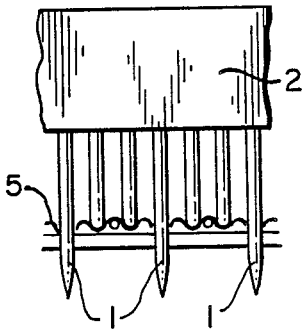
FIG. 3 is a plan view similar to FIG. 2 showing the needles after they have been advanced from the FIG. 2 position to perforate the crepe paper sheet.

The needle bar 2 is reciprocated in conventional manner by the reciprocating means so that the needles 1 are advanced through the position shown in FIG. 2 to bring the crepe paper sheet 5 into restraint by the vertical restraining pins 6, when the needles 1 will penetrate through the crepe paper sheet 5 and advance to the position shown in FIG. 3.

In the position shown in FIG. 3 the embossing stubs 8 have also been brought into contact with the crepe paper sheet on either side of a vertical restraining pin 6 so that the embossing stubs 8 force the crepe paper sheet 5 on either side of the restraining pin 6 past the plane of the, restraining surface of the restraining pin 6 to form permanent depressions in the surface of the crepe paper sheet 5 thereby tending to remove the crimps of the crepe paper sheet 5 at these locations. The depressions remain in the crepe paper sheet 5 when the needle bar 2 is retracted and the needles 1 and the embossing stubs 8 are withdrawn from contact with the crepe paper sheet 5.

The effect of each reciprocation of the needle bar 2 as described with reference to FIGS. 2 and 3 is to cause a pair of projections to be embossed in the surface of the crepe paper sheet 5 on which the weft threads 7 are laid. These weft threads 7 are secured to the crepe paper sheet 5 by the stitching action of the needles 1 consequent upon reciprocation of the needle bar 2.

Figure 4:
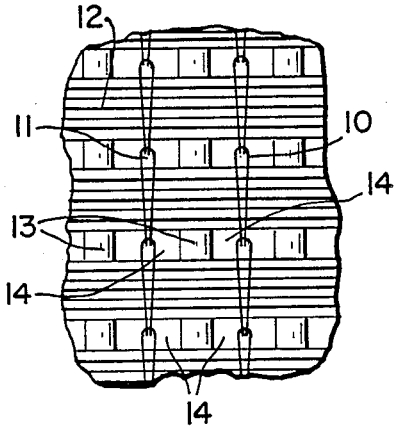
FIG. 4 is a representation of the pattern produced on a portion of a crepe paper sheet after treatment using the sewing-knitting machine of FIGS. 1 to 3.

FIG. 4 is representation of a part of a crepe paper sheet 5 treated by the method just described, the representation in FIG. 4 being of the surface of the sheet 5 on the side from which the needles 1 penetrate, that is to say the opposite surface of the stitched crepe paper sheet 5 to that on which the weft threads 7 are secured. The visual appearance of this side of the crepe paper sheet 5 is that there are side-by-side rows of stitches 10 of which the individual stitches are clearly shown. The stitching thread passes through the crepe paper sheet 5 at the end 11 of each stitch.

Within each stitch there is gathered a plurality of crimps 12 and between each row of stitches there appears to be a projection 13 directly in line with the stitch ends 11 of the stitches, this apparent projection 13 being in reality a position of the crepe paper sheet 5 which is restrained by the restraining pin 6 between the two depressions 14 formed by the embossing stubs 8 as they tend to remove the crimp from the crepe paper sheet 5 at the immediate locality of their impact on the crepe paper sheet 5. Depending on the position to which the embossing stubs 8 are moved relative to the restraining surface of the restraining pin 6 the uppermost surface of the apparent projection 13 may be in fact displaced above the main level of the undulating surface of the crepe paper sheet 5 on the side from which the needles 1 penetrate the crepe paper sheet 5. It must however be remembered that when dealing with crepe paper the position of the surface of the sheet is necessarily uncertain and, in general, the surface of the apparent projection 13 will be at a similar level to the raised surface of a crimp 12 on the same surface of the crepe paper sheet 5.

Figure 5:
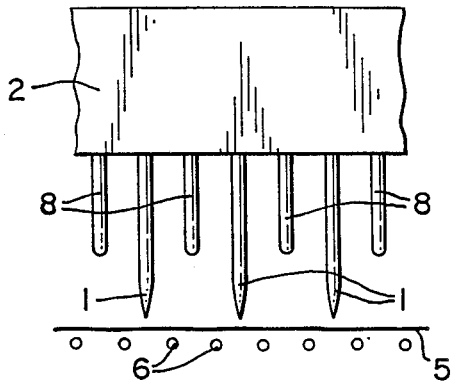
FIG. 5 is a plan view similar to FIG. 2 but showing an alternative arrangement of needle bar and restraining pin to that shown in FIG. 2.

In FIG. 5 there is shown an alternative arrangement of a needle bar 2 having a single embossing stub 8 positioned between each pair of adjacent needles 1. The spacing between the adjacent needles 1 on the needle bar 2 may be, for example, one fifth of an inch (five millimeters) or approximately two fifths of an inch (ten millimeters).

In a sewing-knitting machine arrangement according to FIG. 5 the series of vertical restraining pins 6 has a spacing or pitch which is half the spacing or pitch of the needles 1 with the individual restraining pins 6 so arranged as to be each mid-way between a needle 1 and an adjacent embossing stub 8.

Figure 6:
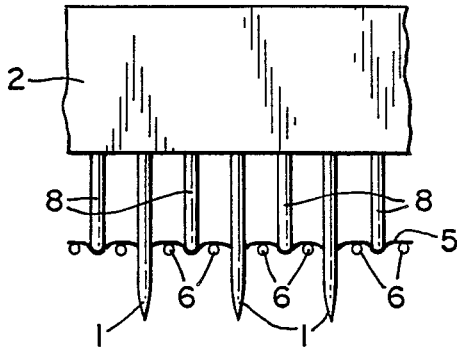
FIG. 6 shows the alternative arrangement of FIG. 5 in a position corresponding to that shown in FIG. 3.
Figure 7:
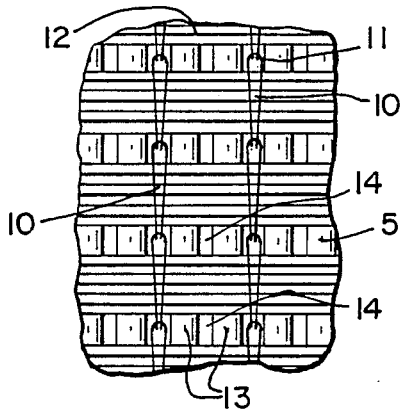
FIG. 7 shows a portion of crepe paper sheet produced using a sewing-knitting machine with the needle bar and restraining pin arrangement of FIGS. 5 and 6.

In the fully actuated position of the needle bar 2 of FIG. 5 which is shown in FIG. 6, each embossing stub 8 has carried a portion of the crepe paper sheet 5 past the restraining surfaces of a pair of adjacent restraining pins 6 and thereby permanently deforms the crepe paper sheet 5 to a depression in the surface of the sheet 5 contacted by the embossing stub 8 and a projection in the surface of the crepe paper sheet 5 to which the weft threads 7 are secured. The restraining pins 6 have the effect of producing pairs of apparent projections 13 on either side of each depression 14 in the surface of the crepe paper sheet 5 as shown in FIG. 7. The action of each embossing stub 8 tends to remove the crimps from the crepe paper sheet 5 at each location where an embossing stub deforms the crepe paper sheet 5.

It will be appreciated that other combinations of embossing stubs 8 and restraining pins 6 may be used to give variations on the same general effects described herein and illustrated in FIGS. 4 and 7.

The crepe paper used in the preferred embodiments of the present invention is a paper having an uncreped weight of 67 gms/sq. meter and a creped weight of 88 gms/sq. meter. After stitching there is a slight reduction in the weight of the paper due to a slight stretching of the paper during the stitching and embossing process.

While the stitched crepe paper has been described herein as a backing for a carpet underlay, it is equally suitable for use as a secondary carpet backing. Indeed it is not beyond the scope of the present invention for the stitched crepe paper made in accordance therewith, and having an enhanced aesthetic appearance as compared with previous stitched crepe papers, to be used for other purposes, for example as a wall covering.

In addition a product in accordance with the present invention is produced with a bunching effect of the crimps 12 in the crepe paper within each stitch. This bunching effect is known to occur in stitched crepe paper when the needles are sufficiently close together for the separation of the crimps 12 made by the needles to remain when the needles have been withdrawn. However in accordance with the present invention the needles forming the stitches can be spaced apart and the bunching effect is still produced by the embossing stubs acting on the crepe paper between the rows of stitches, the bunching effect being produced without a perforation of the paper between the rows of stitches.

This bunching effect, which is illustrated in FIGS. 4 and 7 of the accompanying drawings, significantly improves the transverse rigidity of the final product and gives it a handle more akin to a textile product than a paper product.

I claim:

1. A method of producing a backing material for a carpet underlay by forming a series of side-by-side rows of stitches in a crepe paper sheet which method further includes the step of deforming the crepe paper sheet without puncturing the crepe paper sheet to form at least one row of projections in the crepe paper sheet between each pair of side-by-side rows of stitches.

2. A method according to claim 1, wherein the step of deforming the crepe paper sheet is performed simultaneously with the perforation of the crepe paper sheet by needles forming corresponding stitches in the said side-by-side rows of stitches.

3. A method of producing a backing material for a carpet underlay which comprises the steps of feeding a crepe paper sheet as a base sheet in a sewing-knitting machine which has a needle bar comprising embossing stubs disposed between stitching needles, operating the sewing-knitting machine to form a series of side-by-side rows of stitches in the crepe paper sheet to reduce substantially the extensibility of the crepe paper sheet and, simultaneously with the formation of each stitch, to deform the crepe paper sheet without puncturing the crepe paper sheet to produce embossed projections in the surface of the crepe paper sheet, and causing the machine to lay weft threads on the crepe paper sheet in the direction of the crimps in the crepe paper, the weft threads being secured to the crepe paper sheet by the rows of stitches.

4. A method according to claim 3, wherein projections are side-by-side and are embossed between corresponding stitches in adjacent side-by-side rows of stitches.

5. A method of making a backing material for a carpet underlay in a sewing-knitting machine which comprises a reciprocable needle bar carrying a series of needles and a series of pairs of blunt stubs each pair of blunt stubs separating adjacent needles in the series of needles, a series of restraining members for restraining a sheet material to facilitate perforation thereof by the needles, the series of restraining members having the same pitch as the series of needles with the restraining members situated mid-way between adjacent needles, and means for reciprocating the needle bar to cause the needles to perforate the sheet material, the method comprising the steps of feeding a crepe paper sheet material to the sewing-knitting machine and forming parallel rows of stitches therein, the reciprocation of the needle bar in the formation of the stitches being such that each pair of bluntstubs presses the crepe paper sheet material on either side of the restraining surface on one of the restraining members thereby forming a pair of embossed projections in the crepe paper sheet material without puncturing the crepe paper sheet.

6. A method of making a backing material for a carpet underlay in a sewing-knitting machine which comprises a reciprocable needle bar carrying a series of needles and a series of blunt stubs, each blunt stub separating adjacent needles in the series of needles so that needles and stubs alternate along the needle bar, a series of restraining members for restraining a sheet material to facilitate perforation thereof by the needles, the series of restraining members having half the pitch of the series of needles with the restraining members situated mid-way between a needle and a stub adjacent to that needle, and means for reciprocating the needle bar to cause the needles to perforate the sheet material, the method comprising the steps of feeding a crepe paper sheet material to the sewing-knitting machine and forming parallel rows of stitches therein, the reciprocation of the needle bar in the formation of the stitches being such that each blunt stub presses the crepe paper sheet material between the restraining surfaces on a pair of the restraining members thereby forming an embossed projection in the crepe paper sheet material without puncturing the crepe paper sheet.

* * * * *